United States Patent [19]

Ellis

[11] 4,266,406

[45] May 12, 1981

[54] COOLING SYSTEM FOR CONDENSER COILS

[76] Inventor: Frank Ellis, 3104 Colbert St., Sheffield, Ala. 35660

[21] Appl. No.: 114,406

[22] Filed: Jan. 22, 1980

[51] Int. Cl.[3] ..... F25B 39/04

[52] U.S. Cl. ..... 62/183; 62/279; 62/305; 62/507

[58] Field of Search ..... 62/183, 279, 280, 305, 62/507

[56] References Cited

U.S. PATENT DOCUMENTS

| | | | |
|---|---|---|---|
| 2,278,242 | 12/1940 | Chapman | 62/305 |
| 3,146,609 | 4/1964 | Engalitcheff Jr. | 62/305 |
| 3,800,553 | 4/1974 | Engalitcheff Jr. | 62/305 |
| 3,872,684 | 3/1975 | Scott | 62/183 |
| 4,028,906 | 6/1977 | Gingold et al. | 62/183 |
| 4,170,117 | 10/1979 | Faxon | 62/183 |

*Primary Examiner*—Ronald C. Capossela

*Attorney, Agent, or Firm*—Berman, Aisenberg & Platt

[57] ABSTRACT

The cooling system of the present invention directs a cooling mist onto the condenser coils of a conventional refrigerant charged central air conditioning unit. The mist comprises a mixture of tap water and condensate. The condensate is collected from the runoff of evaporation coils. A sensing unit is provided at the condenser coil return conduit for sensing a rise in refrigerant temperature and thereby causing the cooling mist to be directed onto the condenser coils.

22 Claims, 6 Drawing Figures

FIG. 4.
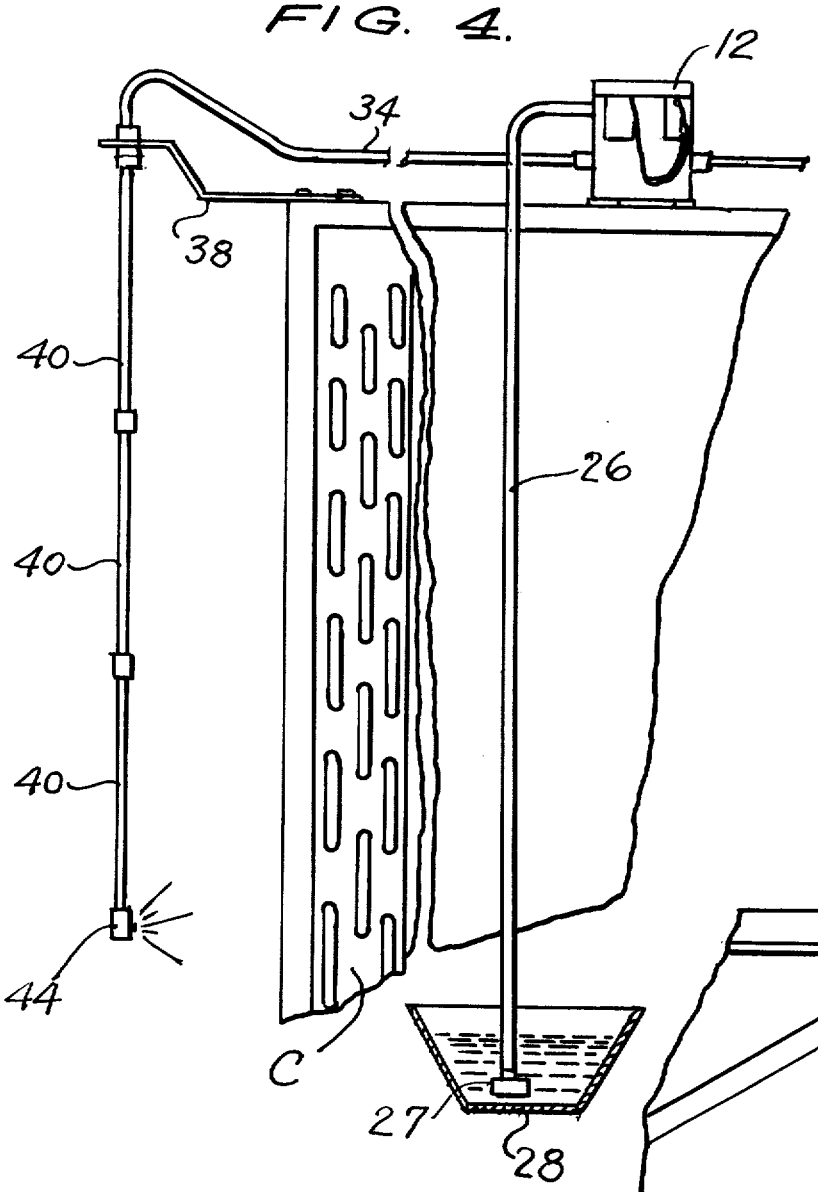
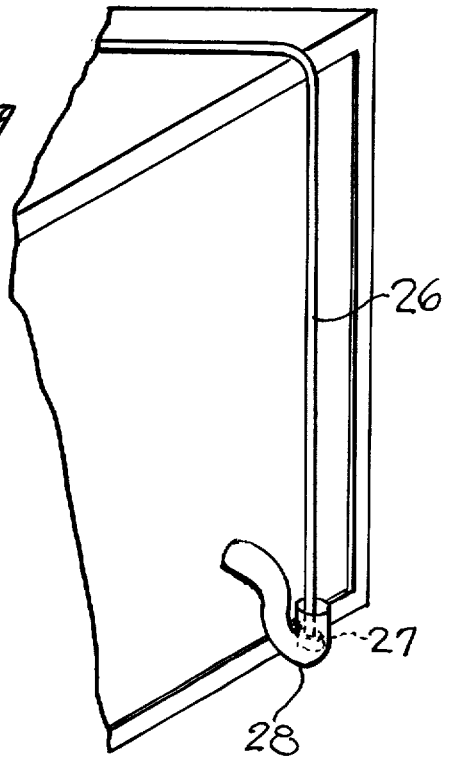
FIG. 3.

COOLING SYSTEM FOR CONDENSER COILS

BACKGROUND OF THE INVENTION

The present invention relates to air conditioning units and in particular to a means for assisting in the cooling of the air conditioner's condenser coils.

The conventional central air conditioning system used for residential dwellings typically includes evaporation coils, condenser coils, a compressor, and a fan which directs an air flow across the condenser coils. Passing a stream of air across the condenser coils cools the coils as well as the refrigerant flowing therethrough. Generally, these elements of the air conditioning system are found in an outside compressor unit although, in some instances, the evaporation coils are not found in the compressor unit but, instead, with a plenum which is a part of the dwelling's ductwork.

In the mechanical refrigeration cycle of a conventional central air conditioning system, a liquid refrigerant is contained initially in a receiver, which is usually located in the lower section of the condenser coils, although it can be contained within a separate tank. The compressor, acting as a pump, forces the liquid refrigerant under high pressure through a conduit to an expansion device.

The function of the expansion device is to regulate the flow of refrigerant into the evaporation coils. This expansion device may be in the form of an expansion valve or a capillary tube.

As the high pressure liquid refrigerant is forced through the expansion device, it expands to a large volume in the evaporation coils, thus reducing its pressure and consequently its boiling temperature. Under this low pressure, the liquid refrigerant boils until it becomes a vapor. During this change of state, the refrigerant absorbs heat from the warm air, i.e., the air within the dwelling, flowing across the outside surfaces of the evaporation coils.

After the refrigerant has boiled or vaporized, thus removing a quota of heat, it is of no more value to the evaporation coils and must be removed to make way for more liquid refrigerant. Instead of being exhausted to the outdoor air, the low pressure heat laden refrigerant vapor is pumped out of the evaporation coils through a conduit to the compressor. The compressor then compresses the refrigerant vapor, increasing its temperature and pressure, and forces it along to the condenser coils.

At the condenser coils, the refrigerant vapor is cooled by lower temperature air passing over the condenser coils, thus absorbing some of the refrigerant heat. As a result, the air temperature increases and the refrigerant temperature decreases until the refrigerant is cooled to saturation condition. At this condition, the vapor will condense to a liquid. The liquid, still under high pressure, flows to the expansion device, thus completing the cycle.

With an energy crisis facing our nation and the world, the efficient use of energy consuming devices is most critical. In the field of air conditioners, and in particular refrigerant charged air conditioners, attempts have been made to reduce the cost of operating such systems by increasing their efficiency.

One manner of improving the cooling efficiency of a central air conditioning compression unit has been to spray a mist of cooling water across the condenser coils, as disclosed in U.S. Pat. No. 3,872,684 to Scott and U.S. Pat. No. 4,028,906 to Gingold et al.

In the Gingold et al apparatus, a mist or fog of water emanates from a nozzle and into the upstream side of the stream of air passing over the condenser coils. The water sprayed onto the condenser coils is a mixture of tap water and a solvent or detergent additive so as to prevent the formation of mineral deposits and other accumulations on the condenser coils. An accumulation of minerals and other deposits would decrease the cooling capacity of the condenser coils.

As for the Scott patent, it discloses the attachment of a radially fluted annular ring to the blower fan blades outer periphery. The annular ring is rotated through a water reservoir at a lower elevation in the compressor unit to thereby cause the water to be vaporized and directed into an air stream passing over the condenser coils.

In both the Gingold et al and Scott cooling systems, the cooling mist is delivered to the condensing coils only upon the operation of the compressor.

It is an object of the present invention to improve upon the cooling systems of air cooled air conditioning condenser coils which have been used in the past.

Another object of the present invention is to provide means for mixing, in appropriate proportions, the condensate from the runoff of the evaporation coils with tap water, and to supply such mixture in the form of a spray or fog across the condenser coils.

Yet a further object of the present invention is to provide means for operating the cooling system for condenser coils independent of the operation of the central air conditioner's compressor or blower fan.

Another object of the present invention is to provide a kit which can be utilized to retrofit existing air conditioning units with the condenser coil cooling system of the present invention.

These and other objects of the present invention will become more apparent from the subsequent description.

SUMMARY OF THE INVENTION

The present invention relates to a cooling system adapted for cooling refrigerant circulating in condenser coils, such as that found in a conventional central air conditioning system. The cooling system includes a fluid valve means for controlling the flow of a cooling fluid therethrough, and means for sensing a temperature differential in the condenser coils refrigerant. The sensing unit is further adapted to activate the fluid valve means upon sensing a predetermined increase in the refrigerant temperature, as well as deactivate the valve means when sensing a predetermined decrease in refrigerant temperature.

Means are further provided for receiving condensate from a source thereof and cooling fluid from the fluid valve means. The condensate is introduced into the receiving means upon the flow of the cooling fluid therethrough. The condensate mixes with the cooling fluid in the receiving means.

The present invention further includes a spray means for receiving the mixture of cooling fluid and condensate, wherein the spray means is adapted for spraying the mixture over the outside surfaces of condenser coils to thereby lower the temperature of the refrigerant flowing therethrough.

BRIEF DESCRIPTION OF THE DRAWINGS

FIG. 3 is a side view showing one means of collecting evaporation coil runoff.

FIG. 4 is a fragmented side elevational view showing another manner of collecting evaporation coil runoff.

DETAILED DESCRIPTION OF THE INVENTION

Referring to the figures, for the purpose of describing the cooling system of the present invention, the compressor unit of a conventional refrigerant charged central air conditioner is hereby designated as A. The compressor unit A comprises a compressor motor B, which is in communication with condenser coils C and evaporation coils D by means of conduits E and F respectively. Condenser coils C and evaporation coils D are likewise in communication with each other by way of the condenser coil return conduit G, also conventionally known as the high side refrigerant line. The operation of these components is essentially the same as that heretofore described for a conventional central air conditioning system.

Figure 2:
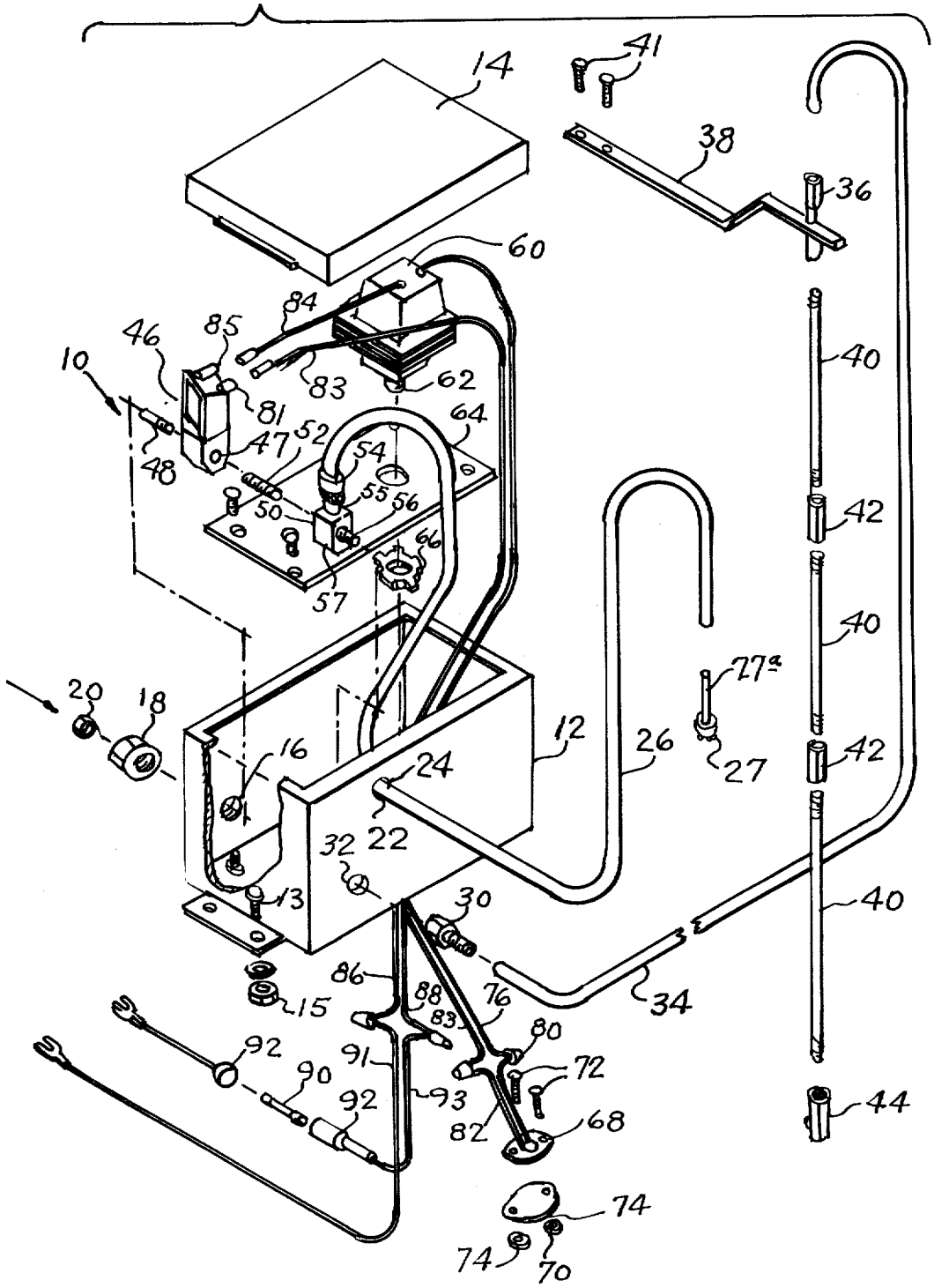
FIG. 2 is an exploded view of the control panel of the present invention and the components associated therewith.

The cooling system of the present invention is generally herein designated as 10, and includes a control panel housing 12 which is mounted on the compressor unit A by conventional means, such as the screws 13 and nuts 15 (shown in FIG. 2). Housing 12 includes a cover 14 for easy access to the components found therein.

Housing 12 is provided with a first opening 16. A water inlet fitting 18 is mounted to the housing 12, coaxial with first opening 16. It is preferable to insert an inlet strainer 20 within the inlet fitting 18. In the general operation of the present invention, a hose, H, extending from a source of tap water will threadably mate with the inlet fitting 18, and the inlet strainer 20 will filter out any large pieces of debris that may be found in the tap water.

A plastic bushing 22 is fitted into a second opening 24 in the control panel housing 12. A flexible siphoning conduit 26 extends from the interior of housing 12, through the bushing 22 and out of the housing 12. A condensate strainer 27 has a tubular member 27(*a*) which is press fitted into the external free end of conduit 26. The strainer 27 is disposed along with a portion of the conduit 26 into a receptacle 28. Condensate which runs off of the evaporation coils D is collected within the receptacle 28. Referencing FIGS. 3 and 4, it is apparent that the receptacle 28 may be of any conventional design, such as the trap shown in FIG. 3 or a pan as shown in FIG. 4.

An outlet fitting 30 is mounted against the housing 12 and is in axial alignment with a third opening 32 formed therein. A spray conduit 34, made of a flexible plastic tubing, mates with the outlet fitting 30 at one end thereof, while the opposite end is press fitted to a fitting 36 which is secured to an elongated bracket member 38. The first of a plurality of rigid tubes 40 threadably mates with the opposite end of the fitting 36, while the remaining tubes extend therefrom in threaded engagement by means of sleeves 42. A spray nozzle 44, capable of spraying a mist or fog over substantially all of the condenser coils, threadably mates with the bottommost tube 40. Preferably, the bracket 38 is mounted to the compressor unit A such that the spray nozzle 44 is approximately 5 inches away from the condenser coils C at a position centrally located to the vertical plane of the condenser coils. Screws 41 secure the bracket 38 to the compressor unit A.

Thus, in the general operation of the present invention, tap water flowing through the hose H to the housing 12, mixes therein with condensate which has been siphoned from receptacle 28. The resulting mixture then flows through the spray conduit 34, the tubes 40 and out through the spray nozzle 44 in the form of a mist or fog. The resulting droplets of water are deposited on the condenser coils C for cooling the coils and the refrigerant, typically freon, which flows therethrough.

Since tap water contains various minerals, i.e., causing water hardness, some mineral deposits on the condenser coils will result. An accumulation of the mineral deposits on the coils eventually reduces the cooling efficiency of the coils. Thus, mixing the tap water with condensate in appropriate proportions, greatly reduces the amount of deposits which will accumulate on the condenser coils. In a typical operation of the present invention, the condensate account for about 38% to 45% of the condensate-tap water mixture, by volume.

The operation of the present invention will become even more apparent from the subsequent description of those components of the present invention which are housed within the housing 12.

An electrically operated solenoid valve 46 communicates with inlet fitting 18 by means of a first tubular nipple 48. Both ends of nipple 48 are threaded and threadably mate with fitting 18 and an inlet port (not shown) of the solenoid valve 46.

Solenoid valve 46 is also in communication with an aspirator type siphon 50 by means of a second tubular nipple 52. An example of a siphon 50 that has been found to be acceptable is that manufactured by Spraying Systems Co., North Ave., Wheaton, Ill. 60187, and identified as a Siphon Injector Br., Part No. 16480. One end of the second nipple 53 threadably mates with an outlet port 47 of the solenoid valve 46 while the opposite end threadably mates with an inlet port (not shown) of the siphon 50. A tubular coupling fixture 54 extends from a second inlet port 55 of the siphon 50 and is in coaxial alignment therewith. That end of the siphon conduit 26 housed within housing 12 is press fitted onto the coupling fixture 54. Also, an outlet coupling 56 extends from the outlet port 57 of the siphon 50 and is in coaxial alignment therewith. Outlet coupling 56 threadably mates with the tubular coupling 30 and thereby mounts the coupling 30 onto the housing 12 and in alignment with the opening 32.

Thus, upon activation of the solenoid valve 46, by means of an electrical current passing therethrough, tap water will be permitted to flow through the solenoid valve 46, second nipple 52 and into the siphon 50. As the tap water flows through a venturi in the siphon 50, it causes an aspirating effect which draws the condensate through the siphon conduit 26 to mix with the tap water within the siphon 50. The resulting mixture exits the siphon 50 and is thereafter delivered to the nozzle 44 by means of the spray conduit 34 and tubes 40. Proper sizing of the siphon 50 venturi provides the appropriate proportions of condensate to tap water.

Figure 6:
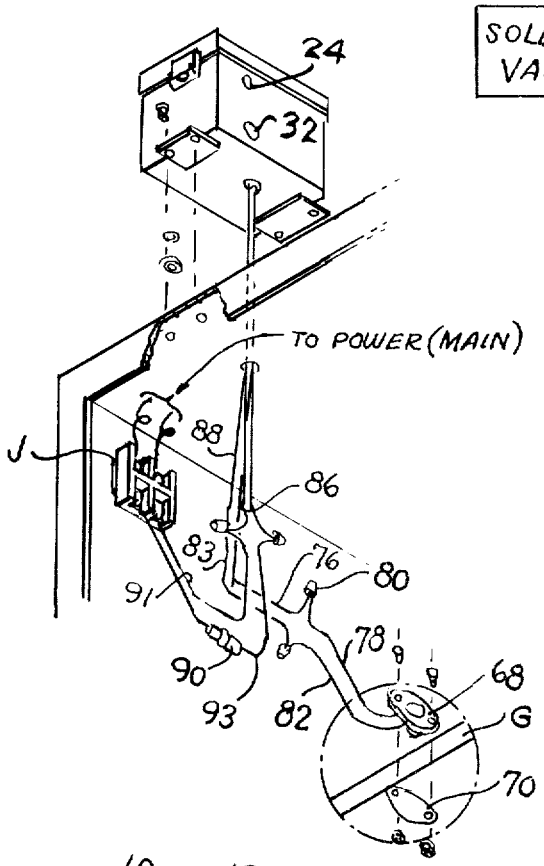
FIG. 6 is a detailed view of the control panel and sensor utilized in the present invention as they are affixed to the conventional compressor unit.
Figure 5:
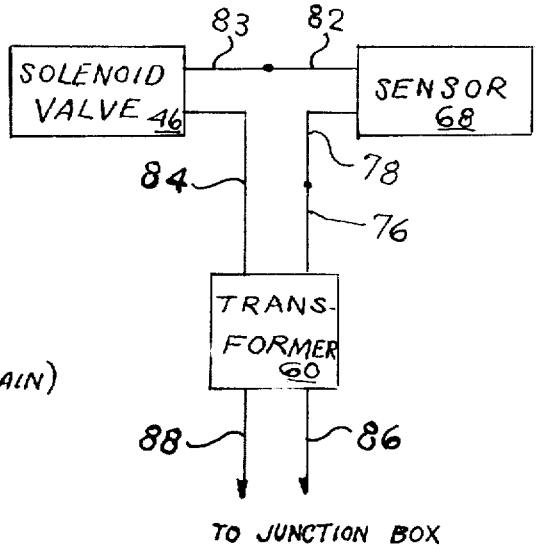
FIG. 5 is a block diagram showing the electrical system of the present invention.
Figure 1:
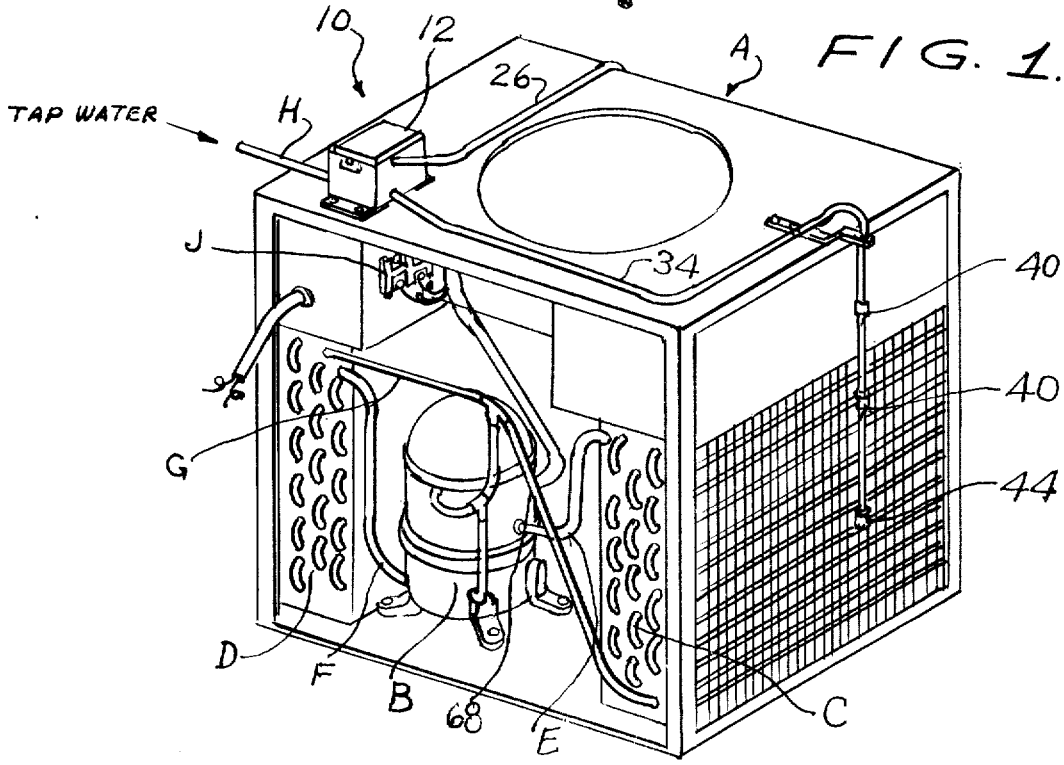
FIG. 1 is a perspective view of the cooling system of the present invention utilized with a conventional compressor unit.

The electrical circuitry of the present invention will be more fully understood from the subsequent description, reference FIGS. 2, 5 and 6.

A transformer 60, typically a 24 volt stepdown transformer, is mounted to a mounting plate 64, by extending the threaded, cylindrically-shaped base 62 thereof through an opening in the mounting plate 64 and threadably engaging such base 62 with a lock washer 66.

A temperature sensor 68 is in intimate contact with the condenser coil return conduit G and is mounted thereon by sandwiching the return conduit G between the sensor 68 and a sensing mounting bracket 70, and retaining said elements in such sandwich formation by means of bolts 72 and nuts 74. Two wire leads 78 and 82 protrude from sensor 68.

Referring to FIGS. 2 and 6, four wire leads extend from the transformer 60. A first lead 76 from the transformer 60 is electrically contacted to a first lead 78 of the sensor 68 by means of splicing cap 80. The second sensor lead 82 electrically connects the sensor 68 to a first terminal 81 of the solenoid valve 46, as it is spliced to a valve lead 83. A second lead 84 from the transformer 60 electrically contacts the second terminal 85 on the solenoid valve 46. The two remaining transformer leads 86 and 88 are respectively spliced to wires 91 and 93 for electrical contact with appropriate terminals on the air conditioner electrical junction box J. It is the junction box J from which the electrical power needed to operate the present invention is obtained. A fuse 90, retained in a fuse housing 92, is interposed between segments of wire 93 to thereby protect the present invention from an overloading condition.

In the operation of the cooling system of the present invention, upon the sensor 68 detecting a predetermined rise in refrigerant temperature, a single-pole-single-throw switch within the sensor is activated, thereby closing the circuit between the solenoid valve 46, transformer 60, sensor 68 and the air conditioner junction box J. As a result of closing the circuit, an appropriate voltage is directed across the terminals of the solenoid valve 46, thereby turning on the solenoid valve and resulting in a mist or fog being distributed across the condensing coils C. The sensor 68 is pre-set so as not to follow freezing of the evaporation coils.

After the refrigerant temperature has sufficiently lowered, the cooling system 10 is automatically turned off upon the sensor 68 discerning such lower temperature. The operating time of the cooling system of the present invention is dependent on the ambient temperature. However, typically the present invention operates for approximately 30 to 40 seconds and is inoperative for a time interval of approximately 1 to 2 minutes.

The cooling system 10 of the present invention was evaluated on an outdoor condensing unit of a three ton Heil split system utilizing a flat-pull thru condenser (Model No. NCAB306AB). The evaporator of the indoor unit was simulated by a refrigerant/water heat exchanger and the indoor blower was assumed to be one-third horsepower. Two types of expansion devices were used, e.g., a capillary tube and thermostatic expansion valve. The system was charged to provide compressor back and head pressures which would have been achieved with an air type evaporator operating under nominal indoor conditions specified by the manufacturer of this unit. As installed on an operational system, the unit mixed condensate from the evaporation coils with tap water from the utility service. In these tests, the indoor unit was simulated with a water coil that produces no condensate. Therefore, it was necessary to supply an additional water source which consisted of a sump from which the cooling system of the present invention extracted condensate.

The cooling capacity of the Heil unit was determined by a precise measurement of the change in temperature of the water through the evaporator and the flow rate of the water. The cooling capacity was calculated by the following formula:

Cooling capacity (Btu/hr) = mass flow rate (lb/hr) × evaporator water temperature drop (°F.).

Electrical energy consumption was measured by a calibrated kilowatt-hour meter of the type used by the utility industry. Pressures were measured by refrigeration service gages and also by recording instruments.

The tests on the three ton Heil air conditioning unit was to assess changes in the unit's performance over a range of ambient temperatures and humidity conditions. Two key performance parameters were measured in the tests, namely, the change in overal Energy Efficiency Ratio (EER) and the change in compressor head pressure. The EER change is an indication of the increased cooling effect per watt hour of electrical energy purchased, while the change in head pressure is an indication of increase in compressor lifetime. Under the heretofore described test conditions, the EER increase ranged from 11% to 19%, and the head pressure decrease ranged from 9% to 17%. Thus, these tests showed a remarkable increase in air conditioning efficiency by utilization of the present invention.

It is most apparent from the heretofore description of the present invention, that it may be in the form of a kit for retrofitting existing central air conditioning units.

The present invention has been described with respect to a compressor unit having both condenser coils and evaporation coils housed therein. It is nevertheless anticipated that the present invention could operate with those central air conditioning systems wherein the evaporation coils are external and separate from the compression unit.

While this invention has been described with respect to a specific embodiment, it is not limited thereto. The appended claims therefore are intended to be construed to encompass all forms and embodiments of the invention, within its true spirit and scope.

What is claimed is:

1. A cooling system adapted for cooling refrigerant circulating in condenser coils, comprising:

fluid valve means adapted for controlling the flow of a cooling fluid therethrough;

means for sensing temperature differentials in the condenser coils refrigerant, and sensing means further adapted to activate said fluid valve means upon sensing a predetermined increase in the refrigerant temperature and deactivate said fluid means upon sensing a predetermined decrease in the refrigerant temperature;

means adapted to receive a flow of the cooling fluid upon activation of said fluid valve means, said receiving means further adapted to introduce condensate into the flow of said cooling fluid so that said condensate mixes with said cooling fluid; and spray means for receiving the mixture of cooling fluid and condensate and adapted for spraying said mixture over the outside surfaces of said condenser coils to thereby lower the temperature of refrigerant flowing therethrough.

2. The cooling system according to claim 1 wherein said temperature sensing means is adapted to sense the temperature of the refrigerant as it exits from the condenser coils.

3. The cooling system according to claim 1 further comprising means for collecting condensate runoff, said collection means being the source of said condensate.

4. The cooling system according to claim 1 wherein said receiving and mixing means is adapted so that the condensate accounts for about 38% to 45% of said condensate-cooling fluid mixture by volume.

5. The cooling system according to claim 1 wherein said receiving and mixing means is a siphon adapted for drawing therein condensate from a source thereof and for mixing therein said condensate with said cooling fluid.

6. The cooling system according to claim 5 wherein said siphon has a venturi opening of predetermined dimension to thereby regulate the condensate-cooling fluid mixture.

7. The cooling system according to claim 5 wherein said siphon further comprises a flexible tubing having an end attached to an inlet port of said siphon and an opposite end attached to a means for straining siphoned condensate.

8. The cooling system according to claim 7 wherein said straining means is adapted to be disposed within a receptacle for collecting condensate.

9. The cooling system according to claim 1 wherein said receiving and mixing means comprises an aspirator-type siphon.

10. The cooling system according to claim 1 wherein said spraying means is a fogger spray nozzle.

11. The cooling system according to claim 1 further comprising means for adjusting displacement of said spraying means from the condenser coils.

12. The cooling system according to claim 1 wherein said fluid valve means is an electrically activated solenoid valve.

13. The cooling system according to claim 12 wherein said solenoid valve has an inlet port and an outlet port, a source of cooling fluid is in communication with said solenoid inlet port and said outlet port is in communication with said receiving and mixing means.

14. The cooling system according to claim 1 wherein said sensing means is electrically connected in series to said valve means and both said valve means and said sensing means are electrically connected in series to a transformer means.

15. The cooling system according to claim 14 wherein said transformer means is electrically connected to an external source of electrical power.

16. The cooling system according to claim 1 wherein said cooling fluid is tap water.

17. A cooling system adapted for spraying a cooling must over the outside surface of condenser coils to thereby lower the temperature of a refrigerant flowing therethrough, comprising:

a housing;

a fluid valve means disposed within said housing and adapted for controlling the flow of a cooling fluid therethrough, said valve means in communication with a source of cooling fluid external to said housing;

a receiving means located within said housing and in communication with said valve means for receiving a flow of cooling fluid therefrom;

a condensate conduit attached to an inlet port of said receiving means, said conduit extending through said housing and having a strainer means fixed to said end external to said housing, said conduit strainer end adapted for placement into a source of condensate, said receiving means adapted to draw said condensate therethrough upon receiving a flow of cooling fluid from said valve means, said condensate caused to mix with said cooling fluid in said receiving means and said mixture delivered to an outlet port of said siphon;

a sprayer conduit attached to said receiving means outlet port and extending out of said housing and thereafter attached to a sprayer nozzle, said nozzle disposed relative to said condenser coils such that a spray therefrom of said cooling fluid-condensate mixture covers said condenser coils; and a sensor means external to said housing being adapted to sense an increase in the temperature of a refrigerant flowing from said condenser coils, said sensor means in electrical communication with said valve means to thereby activate said valve means upon the sensing of a predetermined increase in refrigerant temperature.

18. The cooling system according to claim 17 wherein said housing is attached to the compressor unit of a central air conditioning system.

19. The cooling system according to claim 17 wherein said valve means is an electrically operated solenoid valve.

20. The cooling system according to claim 17 further comprising an electrical transformer disposed in said housing and electrically connected in series to said sensor means and said valve means and further in electrical contact with an electrical power source external to said housing.

21. The cooling system according to claim 17 wherein said receiving means is a siphon.

22. In a refrigerant charged central air conditioning system having evaporation coils, condenser coils and a compressor, with a refrigerant return conduit extending from said condenser coils to said evaporation coils, wherein the improvement comprises:

fluid valve means adapted for controlling the flow of a cooling fluid therethrough;

temperature sensing means disposed on said return conduit for sensing an increase in said refrigerant temperature as said refrigerant flows from said condenser coils to said evaporation coils, said sensing means adapted to activate said fluid valve means upon sensing said predetermined increase in the refrigerant temperature and deactivate said fluid valve means upon sensing a predetermined decrease in the refrigerant temperature;

means for receiving condensate collected from said evaporation coils runoff, said siphoning means adapted to also receive a flow of the cooling fluid upon activation of said fluid valve means, said receiving means further adapted to receive the evaporation coils condensate upon the flow of said cooling fluid therethrough so that said condensate mixes with said cooling fluid in said receiving means; and spray means for receiving the mixture of cooling fluid and condensate and adapted for spraying said mixture over the outside surface of said condenser coils to thereby lower the temperature of refrigerant flowing therethrough.

* * * * *